US012161271B2

(12) United States Patent
Sun

(10) Patent No.: US 12,161,271 B2
(45) Date of Patent: Dec. 10, 2024

(54) TOILET SEAT

(71) Applicant: Shanghai Kohler Electronics, Ltd., Shanghai (CN)

(72) Inventor: Xiaoquan Sun, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 51 days.

(21) Appl. No.: 17/968,158

(22) Filed: Oct. 18, 2022

(65) Prior Publication Data

US 2023/0140484 A1 May 4, 2023

(30) Foreign Application Priority Data

Oct. 28, 2021 (CN) ..... 202122615796.X

(51) Int. Cl.
*A47K 13/02* (2006.01)

(52) U.S. Cl.
CPC ..... *A47K 13/02* (2013.01)

(58) Field of Classification Search
CPC ..... A47K 13/02
See application file for complete search history.

(56) References Cited

U.S. PATENT DOCUMENTS

2014/0223652 A1* 8/2014 Jin ..... A47K 13/02 264/255
2022/0110492 A1* 4/2022 Nakamura ..... A47K 13/02

FOREIGN PATENT DOCUMENTS

CN 210227994 U 4/2020

OTHER PUBLICATIONS

Extended European Search Report from European Patent No. 22203034.8, dated Apr. 6, 2023, 8 pages.

* cited by examiner

*Primary Examiner* — Christine J Skubinna
(74) *Attorney, Agent, or Firm* — Lempia Summerfield Katz, LLC

(57) ABSTRACT

The present disclosure relates to a toilet seat, comprising a seat lower cover and a seat upper cover. The seat lower cover comprises a lower cover baseplate, a lower cover outer periphery boss, and a lower cover inner periphery boss. The seat upper cover comprises an upper cover baseplate, an upper cover outer periphery flange, an upper cover inner periphery flange, an upper cover outer periphery boss, and an upper cover inner periphery boss. The upper cover inner periphery boss is welded with the lower cover inner periphery boss, the upper cover outer periphery boss is welded with the lower cover outer periphery boss, and the upper cover outer periphery flange and the upper cover inner periphery flange are contacted with the lower cover baseplate respectively. The toilet seat is convenient to be assembled and is stable in structure through welded connection, so that a product quality is improved.

18 Claims, 7 Drawing Sheets

TOILET SEAT

CROSS-REFERENCE TO RELATED APPLICATION

This application claims the benefit of priority to Chinese Patent Application No. 202122615796.X, filed in the Chinese Intellectual Property Office on Oct. 28, 2021, which is hereby incorporated by reference in its entirety.

FIELD

The present disclosure relates to the field of toilet technologies, and more particularly, to a toilet seat.

BACKGROUND

A toilet seat of a toilet is usually formed by connecting upper and lower covers, and a cavity is formed between the upper and lower covers to reduce structural weight and save material cost.

In the toilet, the upper and lower covers are usually connected by means of screw or gluing. When connecting the upper and lower covers with screws, many screws need to be punched around the inner and outer peripheries of the upper and lower covers, and the operation is cumbersome. When connecting the upper and lower covers with glue, it is necessary to set a wide gluing platform on the upper and lower covers, which requires a lot of materials and reduces the cavity between the upper and lower covers. Moreover, as time goes by, the glue may age, causing cracks between the upper and lower covers of the toilet seat and even causing the upper and lower covers to separate from each other.

In view of this, it is necessary to provide a toilet seat which is convenient to be assembled and is stable in structure.

SUMMARY

The present disclosure aims to provide a toilet seat, which is convenient to be assembled and is stable in structure.

The present disclosure provides a toilet seat, comprising a seat lower cover and a seat upper cover mounted on the seat lower cover.

The seat lower cover comprises a lower cover baseplate with a lower cover through hole, a lower cover outer periphery boss surrounding an inner side of an outside edge of the lower cover baseplate, and a lower cover inner periphery boss surrounding an outer side of the lower cover through hole.

The seat upper cover comprises an upper cover baseplate with an upper cover through hole. The seat upper cover further comprises an upper cover outer periphery flange extending downwardly from an outside edge of the upper cover baseplate. The seat upper cover further comprises an upper cover inner periphery flange extending downwardly from an edge of the upper cover through hole. The seat upper cover further comprises an upper cover outer periphery boss surrounding an inner side of the upper cover outer periphery flange. The seat upper cover further comprises an upper cover inner periphery boss surrounding an outer side of the upper cover inner periphery flange.

The upper cover inner periphery boss is welded with the lower cover inner periphery boss, the upper cover outer periphery boss is welded with the lower cover outer periphery boss, and the upper cover outer periphery flange and the upper cover inner periphery flange are contacted with the lower cover baseplate respectively.

In one embodiment, the upper cover outer periphery boss is provided with a plurality of outer periphery boss recesses at intervals.

In one embodiment, the upper cover inner periphery boss is provided with a plurality of inner periphery boss recesses at intervals.

In one embodiment, an outer periphery flashing groove is formed between the upper cover outer periphery boss and the upper cover outer periphery flange.

In one embodiment, an inner periphery flashing groove is formed between the upper cover inner periphery boss and the upper cover inner periphery flange.

In one embodiment, a plurality of first reinforcing ribs are connected between the upper cover outer periphery boss and the upper cover outer periphery flange.

In one embodiment, a plurality of second reinforcing ribs are connected between the upper cover inner periphery boss and the upper cover inner periphery flange.

In one embodiment, a width of the lower cover inner periphery boss is greater than a width of the upper cover inner periphery boss, and a width of the lower cover outer periphery boss is greater than a width of the upper cover outer periphery boss.

In one embodiment, the upper cover outer periphery flange, the upper cover inner periphery flange, the upper cover outer periphery boss and the upper cover inner periphery boss are integrally formed with the upper cover baseplate respectively.

In one embodiment, the lower cover outer periphery boss and the lower cover inner periphery boss are integrally formed with the lower cover baseplate respectively.

By adopting the foregoing technical solutions, the following beneficial effects can be achieved.

According to the toilet seat provided by the present disclosure, the upper cover inner periphery boss and the upper cover outer periphery boss are arranged on the upper cover, the lower cover inner periphery boss and the lower cover outer periphery boss are arranged on the lower cover, the upper cover inner periphery boss is welded with the lower cover inner periphery boss, and the upper cover outer periphery boss is welded with the lower cover outer periphery boss. Thus, the toilet seat is convenient to be assembled and is stable in structure through welded connection, so that a product quality is improved.

DETAILED DESCRIPTION

Figure 1:
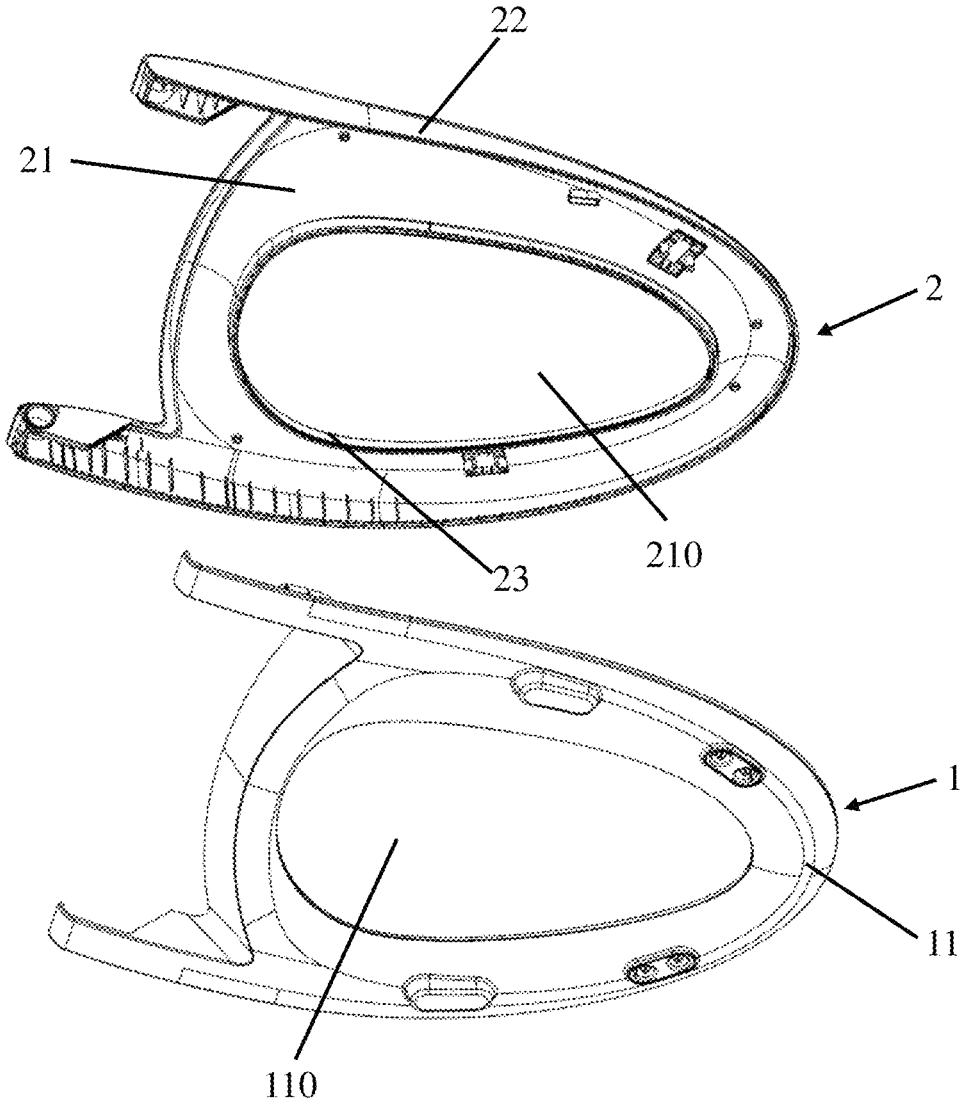
FIG. 1 is an exploded view of a toilet seat according to an embodiment of the present disclosure.

The specific embodiments of the present disclosure are further described with reference to the drawings hereinafter. Same or equivalent parts are denoted by same reference numerals. It should be noted that the terms “front”, “back”, "left", "right", "up", and "down" used in the following description refer to the directions in the accompanying drawings, and the terms "inner" and "outer" refer to the directions toward or far away from geometric center of a specific part respectively.

Figure 2:
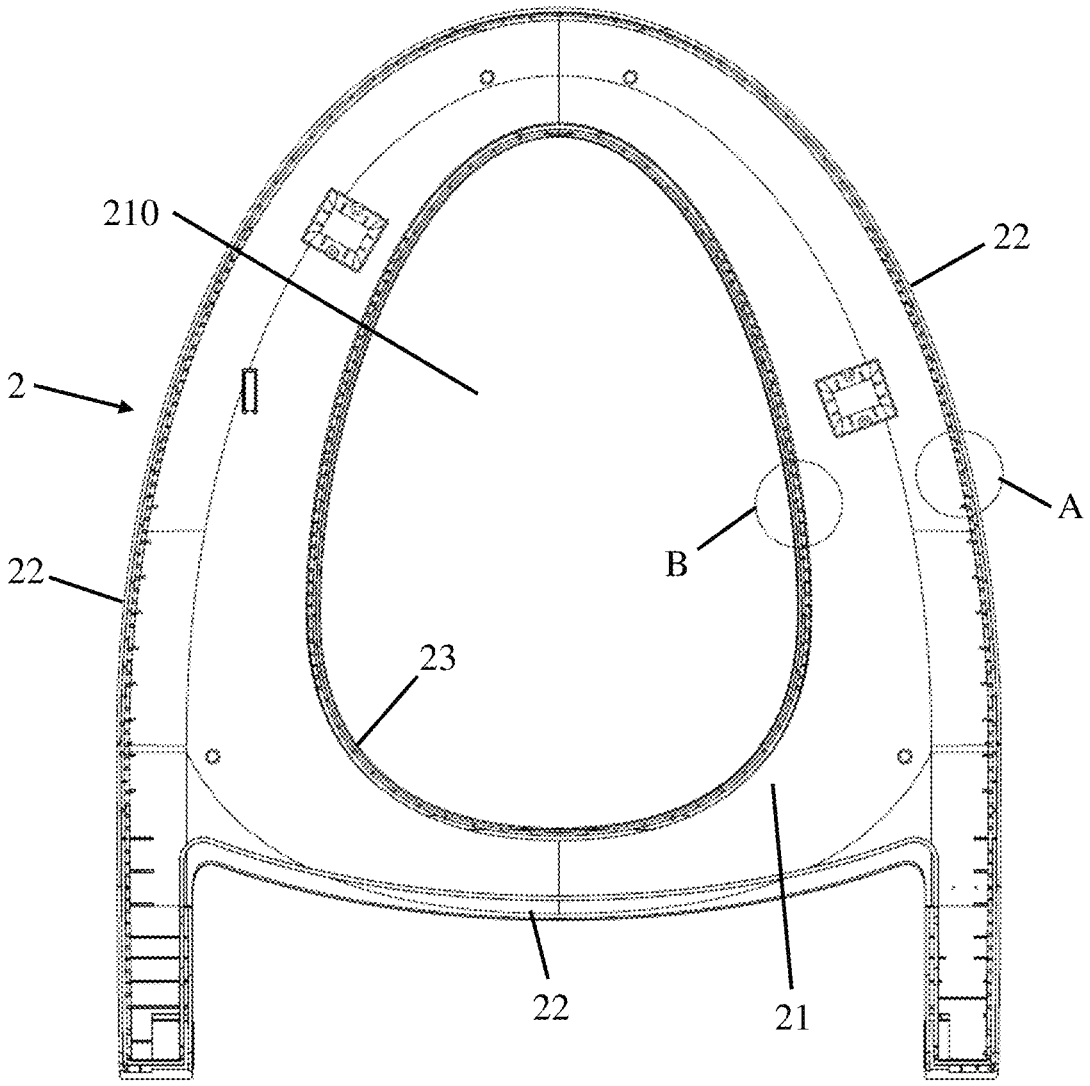
FIG. 2 is a front view of a seat upper cover.
Figure 3:
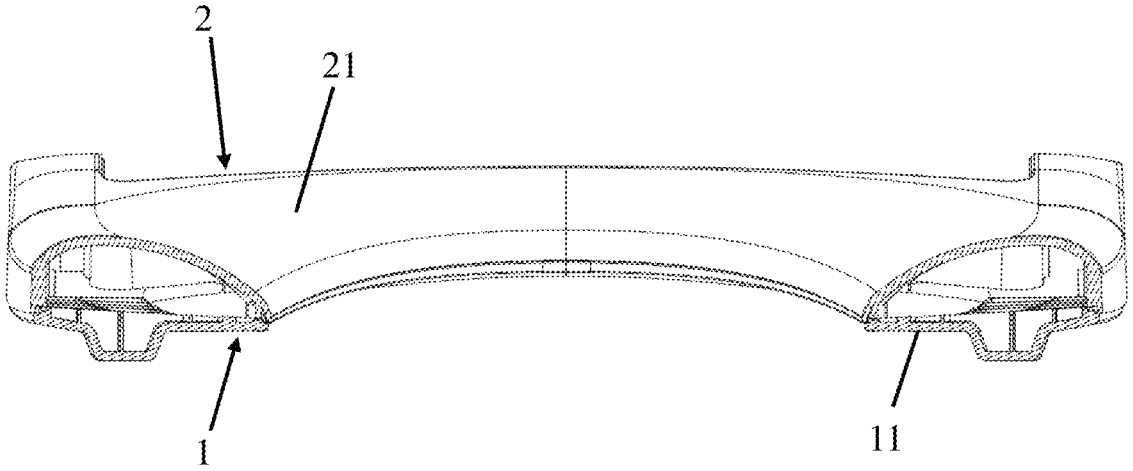
FIG. 3 is a sectional view of the toilet seat.
Figure 4:
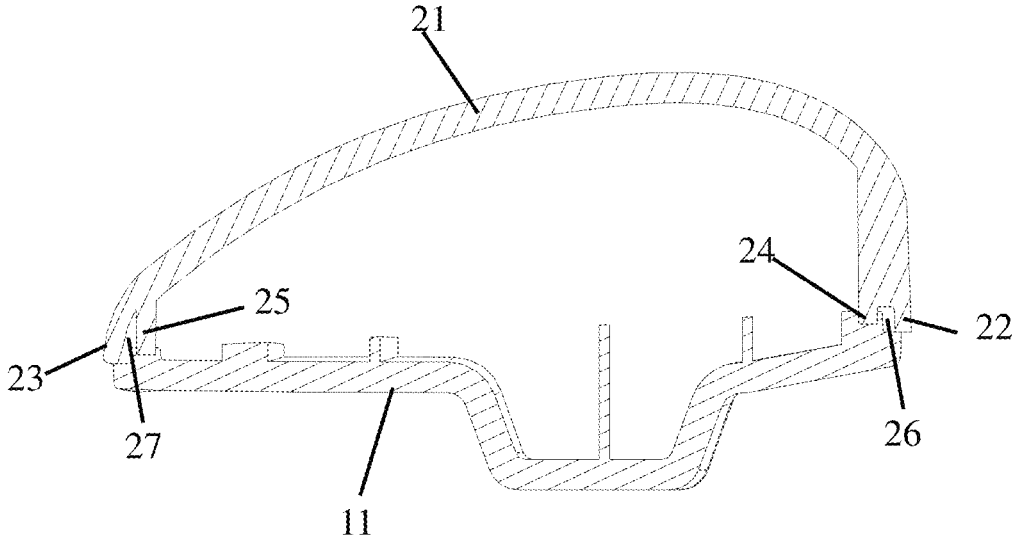
FIG. 4 is a partial enlarged view of FIG. 3.
Figure 5:
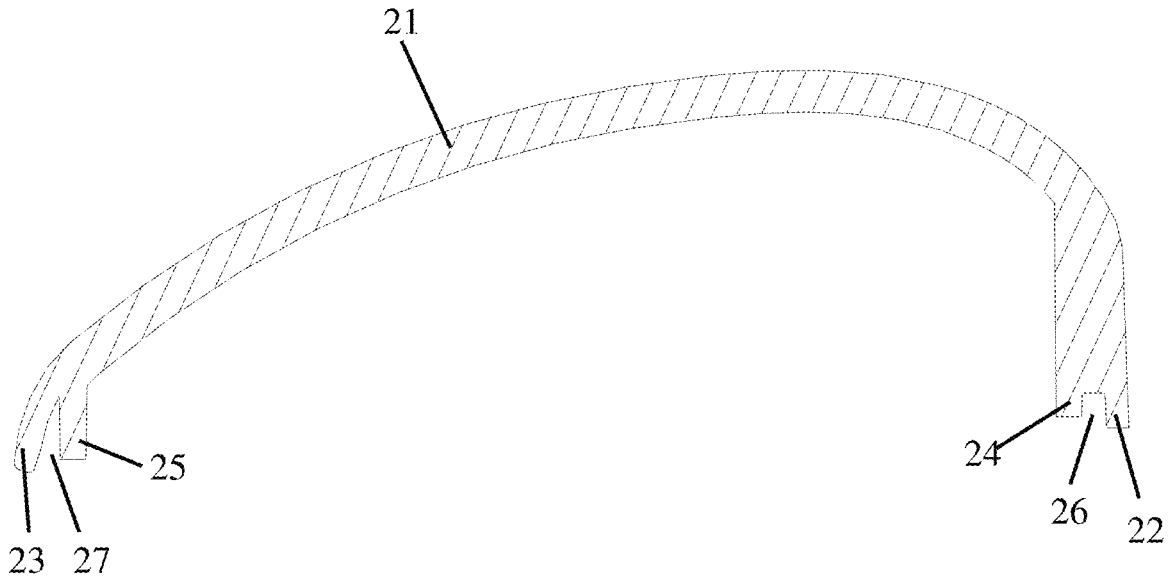
FIG. 5 is a sectional view of the seat upper cover.
Figure 6:
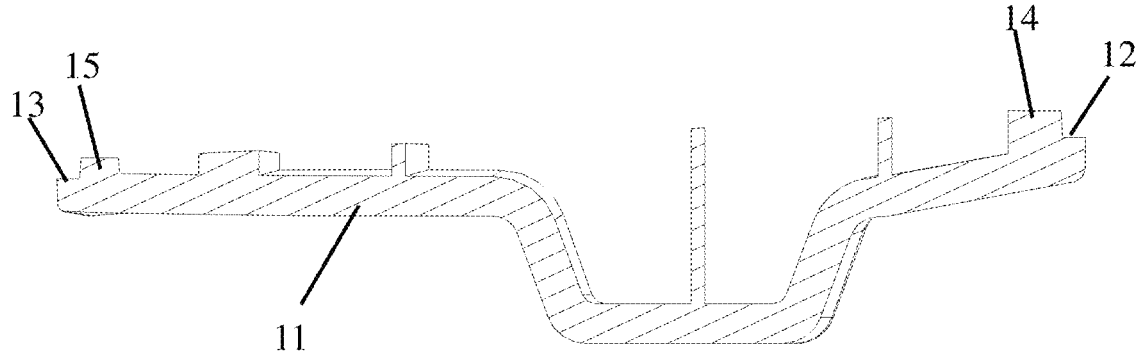
FIG. 6 is a sectional view of a seat lower cover.

FIG. 1 is an exploded view of a toilet seat according to an embodiment of the present disclosure; FIG. 2 is a front view of a seat upper cover; FIG. 3 is a sectional view of the toilet seat; FIG. 4 is a partial enlarged view of FIG. 3; FIG. 5 is a sectional view of the seat upper cover; and FIG. 6 is a sectional view of a seat lower cover. As shown in FIGS. 1-6, a toilet seat provided by an embodiment of the present disclosure comprises a seat lower cover 1 and a seat upper cover 2 mounted on the seat lower cover 1.

The seat lower cover 1 comprises a lower cover baseplate 11 with a lower cover through hole 110, a lower cover outer periphery boss 14 surrounding an inner side of an outside edge of the lower cover baseplate 11, and a lower cover inner periphery boss 15 surrounding an outer side of the lower cover through hole 110.

The seat upper cover 2 comprises an upper cover baseplate 21 with an upper cover through hole 210. The seat upper cover 2 further comprises an upper cover outer periphery flange 22 extending downwardly from an outside edge of the upper cover baseplate 21. The seat upper cover 2 further comprises an upper cover inner periphery flange 23 extending downwardly from an edge of the upper cover through hole 210. The seat upper cover 2 further comprises an upper cover outer periphery boss 24 surrounding an inner side of the upper cover outer periphery flange 22. The seat upper cover 2 further comprises an upper cover inner periphery boss 25 surrounding an outer side of the upper cover inner periphery flange 23.

The upper cover inner periphery boss 25 is welded with the lower cover inner periphery boss 15, the upper cover outer periphery boss 24 is welded with the lower cover outer periphery boss 14, and the upper cover outer periphery flange 22 and the upper cover inner periphery flange 23 are contacted with the lower cover baseplate 11 respectively.

The toilet seat provided by this embodiment is a part of a toilet. The toilet seat comprises the seat lower cover 1 and the seat upper cover 2. The seat upper cover 2 and the seat lower cover 1 are in welded connection.

The seat lower cover 1 comprises the lower cover baseplate 11, and the lower cover baseplate 11 is provided with the lower cover through hole 110. A top surface of the lower cover baseplate 11 is provided with the lower cover outer periphery boss 14 and the lower cover inner periphery boss 15. The lower cover outer periphery boss 14 is located at an inner side of an outside edge or an outside contour of the lower cover baseplate 11, and the lower cover outer periphery boss 14 is a convex ring with a closed-loop structure. An annular outer periphery platform 12 is formed between the lower cover outer periphery boss 14 and the outside edge or the outside contour of the lower cover baseplate 11. The lower cover inner periphery boss 15 is located at the outer side of the lower cover through hole 110 and surrounds a periphery of the lower cover through hole 110. The lower cover inner periphery boss 15 is a convex ring with a closed-loop structure. An annular inner periphery platform 13 is formed between the lower cover inner periphery boss 15 and the edge or the contour of the lower cover through hole 110.

The seat upper cover 2 comprises the upper cover baseplate 21, and the upper cover baseplate 21 is provided with the upper cover through hole 210. When the seat upper cover 2 is mounted on the seat lower cover 1, the lower cover through hole 110 is butted with the upper cover through hole 210 to form a seat through hole. The upper cover outer periphery flange 22 extends downwardly from the outside edge or outside contour of the upper cover baseplate 21, and the upper cover outer periphery flange 22 has a closed-loop structure. The upper cover inner periphery flange 23 extends downwardly from the edge of the upper cover through hole 210, and the upper cover inner periphery flange 23 also has a closed-loop structure. The upper cover outer periphery boss 24 surrounds the inner side of the upper cover outer periphery flange 22, and the upper cover outer periphery boss 24 is a convex ring with a closed-loop structure. The upper cover inner periphery boss 25 surrounds the outer side of the upper cover inner periphery flange 23, and the upper cover inner periphery boss 25 is also a convex ring with a closed-loop structure.

The toilet seat is a plastic part. Therefore, the lower cover outer periphery boss 14, the lower cover inner periphery boss 15, the upper cover outer periphery boss 24, and the upper cover inner periphery boss 25 are all plastic parts and may be connected by welding. In other words, the lower cover outer periphery boss 14, the lower cover inner periphery boss 15, the upper cover outer periphery boss 24, and the upper cover inner periphery boss 25 are all welded ribs or welded convex rings.

When the toilet seat is assembled, the seat lower cover 1 and the seat upper cover 2 are connected and fixed by a welding process. The welding process may be a laser welding process, e.g., a friction welding process. When the toilet seat is assembled, the upper cover outer periphery boss 24 is butted and welded with the lower cover outer periphery boss 14, and the upper cover inner periphery boss 25 is butted and welded with the lower cover inner periphery boss 15. After welding, the upper cover outer periphery flange 22 is at least partially overlapped or disposed on the outer periphery platform 12, and the upper cover inner periphery flange 23 is at least partially overlapped or disposed on the inner periphery platform 13, which is convenient for assembly and improves the connection stability of the seat lower cover 1 and the seat upper cover 2.

Figure 7:
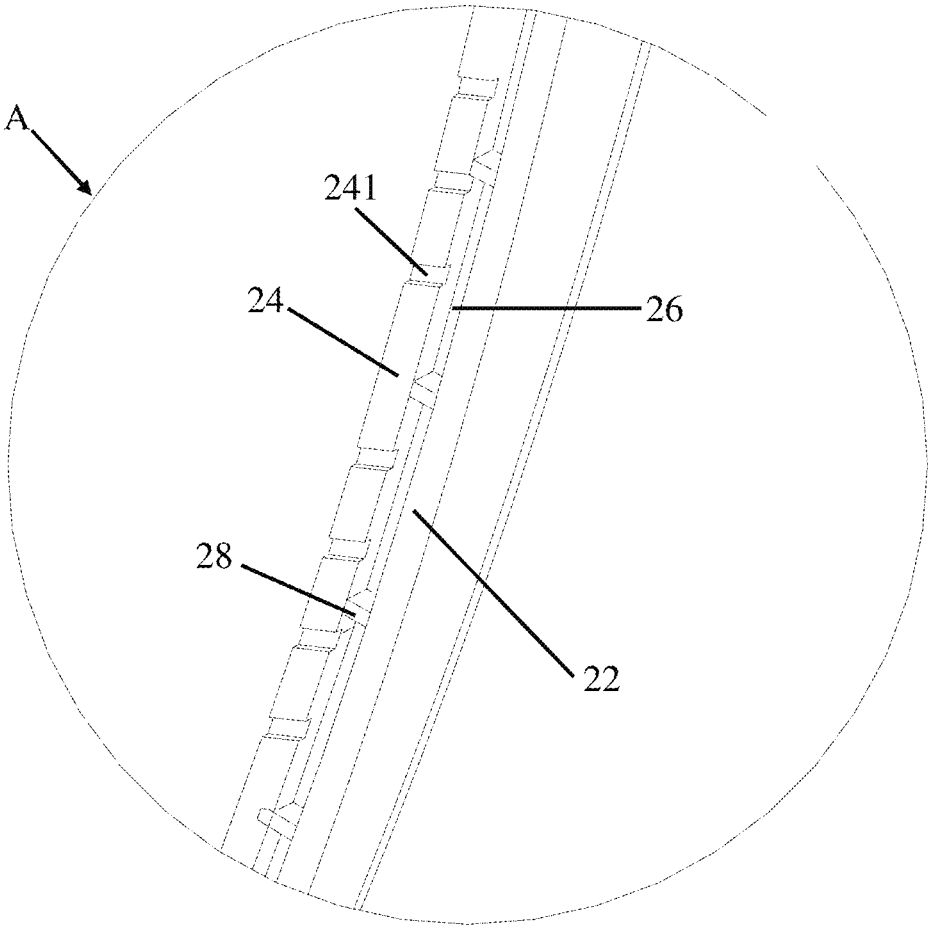
FIG. 7 is an enlarged view of region A in FIG. 2.

FIG. 7 is an enlarged view of region A in FIG. 2. In one embodiment, as shown in FIG. 7, the upper cover outer periphery boss 24 is provided with a plurality of outer periphery boss recesses 241 at intervals, which reduce a surface size of the upper cover outer periphery boss 24 and facilitate plastic deformation of the upper cover outer periphery boss 24 during welding, so as to be in welded connection with the lower cover outer periphery boss 14.

Figure 8:
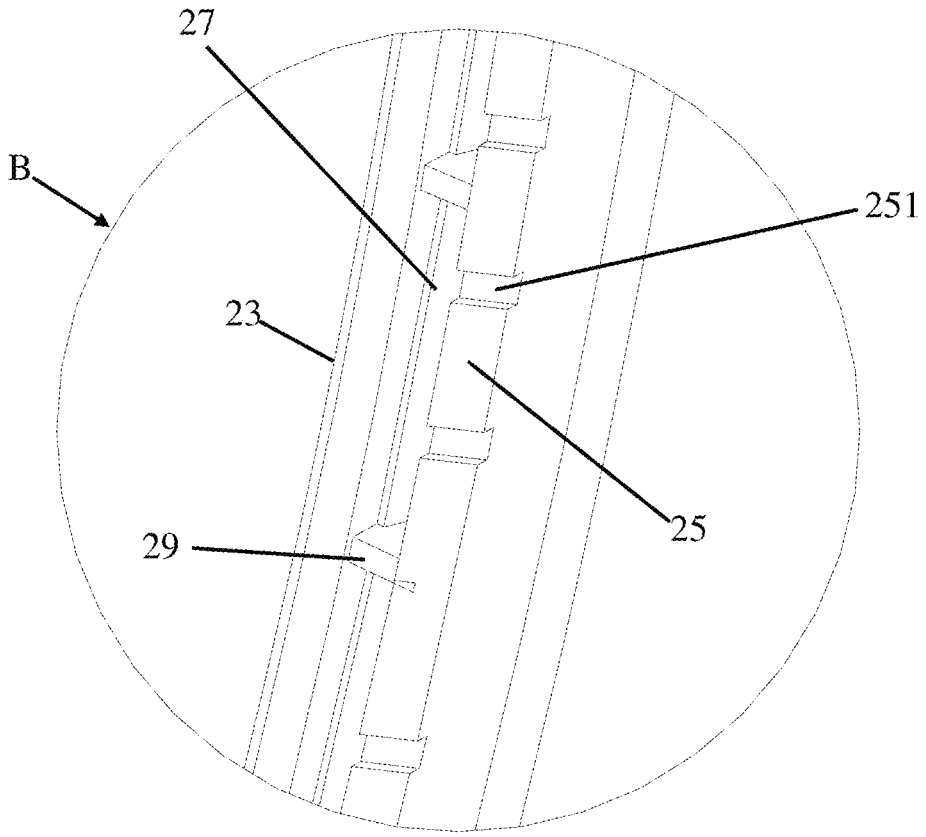
FIG. 8 is an enlarged view of region B in FIG. 2.

FIG. 8 is an enlarged view of region B in FIG. 2. In one embodiment, as shown in FIG. 8, the upper cover inner periphery boss 25 is provided with a plurality of inner periphery boss recesses 251 at intervals, which reduce a surface size of the upper cover inner periphery boss 25 and facilitate plastic deformation of the upper cover inner periphery boss 25 during welding, so as to be in welded connection with the lower cover inner periphery boss 15.

Widths of the outer periphery boss recess 241 and the inner periphery boss recess 251 may be approximately 1.0 mm, and depths thereof may be approximately 0.5 mm.

In one embodiment, as shown in FIGS. 4 and 5, an outer periphery flashing groove 26 is formed between the upper cover outer periphery boss 24 and the upper cover outer periphery flange 22. Flash overflow produced when welding the upper cover outer periphery boss 24 and the lower cover outer periphery boss 14 may flow into the outer periphery flashing groove 26. Thus, good welding quality may be ensured and bad product appearance caused by the flash overflow exposure may be avoided.

A cross-sectional area of the outer periphery flashing groove 26 is greater than or equal to 70% of a cross-sectional area of the upper cover outer periphery boss 24, so as to leave enough flashing space.

In one embodiment, as shown in FIGS. 4 and 5, an inner periphery flashing groove 27 is formed between the upper cover inner periphery boss 25 and the upper cover inner periphery flange 23. Flash overflow produced when welding the upper cover inner periphery boss 25 and the lower cover inner periphery boss 15 may flow into the inner periphery flashing groove 27. Thus, good welding quality may be ensured and bad product appearance caused by the flash overflow exposure may be avoided.

A cross-sectional area of the inner periphery flashing groove 27 is greater than or equal to 70% of a cross-sectional area of the upper cover inner periphery boss 25, so as to leave enough flashing space.

In one embodiment, as shown in FIG. 7, a plurality of first reinforcing ribs 28 are connected between the upper cover outer periphery boss 24 and the upper cover outer periphery flange 22. Thus, a structural strength of the upper cover outer periphery boss 24 may be improved, and the upper cover outer periphery boss 24 may be prevented from shaking and misaligning with the lower cover outer periphery boss 14 during a welding operation.

In one embodiment, each first reinforcing rib 28 is flush, leveled, or aligned with the upper cover outer periphery boss 24, and the first reinforcing rib 28 also participates in welding and melting. Thus, welded connection strength may be improved.

In one embodiment, as shown in FIG. 8, a plurality of second reinforcing ribs 29 are connected between the upper cover inner periphery boss 25 and the upper cover inner periphery flange 23. Thus, a structural strength of the upper cover inner periphery boss 25 may be improved, and the upper cover inner periphery boss 25 may be prevented from shaking and misaligning with the lower cover inner periphery boss 15 during a welding operation.

In one embodiment, each second reinforcing rib 29 is flush, leveled, or aligned with the upper cover inner periphery boss 25, and the second reinforcing rib 29 also participates in welding and melting. Thus, welded connection strength may be improved.

Widths of the first reinforcing rib 28 and the second reinforcing rib 29 may be approximately 1.0-1.2 mm, and intervals thereof may be approximately 5 mm.

In one embodiment, as shown in FIGS. 4-6, a width of the lower cover inner periphery boss 15 is greater than that of the upper cover inner periphery boss 25. Thus, butted welding between the upper cover inner periphery boss 25 and the lower cover inner periphery boss 15 may be facilitated to form a wider welding surface, so as to improve a welded connection strength between the upper cover inner periphery boss 25 and the lower cover inner periphery boss 15.

A width of the lower cover outer periphery boss 14 is greater than that of the upper cover outer periphery boss 24. Thus, butted welding between the upper cover outer periphery boss 24 and the lower cover outer periphery boss 14 may be facilitated to form a wider welding surface, so as to improve a welded connection strength between the upper cover outer periphery boss 24 and the lower cover outer periphery boss 14.

Specifically, the widths of the upper cover outer periphery boss 24 and the upper cover inner periphery boss 25 may be approximately 2.0 mm, while the widths of the lower cover outer periphery boss 14 and the lower cover inner periphery boss 15 may be approximately 3.0 mm After welding, a welding surface with a width of approximately 2.0-2.5 mm is formed.

In one embodiment, the upper cover outer periphery flange 22, the upper cover inner periphery flange 23, the upper cover outer periphery boss 24, and the upper cover inner periphery boss 25 are integrally formed with the upper cover baseplate 21 respectively. The seat upper cover 2 may be integrally molded by injection molding, which is convenient for processing and molding and has high structural strength.

In one embodiment, the lower cover outer periphery boss 14 and the lower cover inner periphery boss 15 are integrally formed with the lower cover baseplate 11 respectively. The seat lower cover 1 may be integrally molded by injection molding, which is convenient for processing and molding and has high structural strength.

Figure 9:
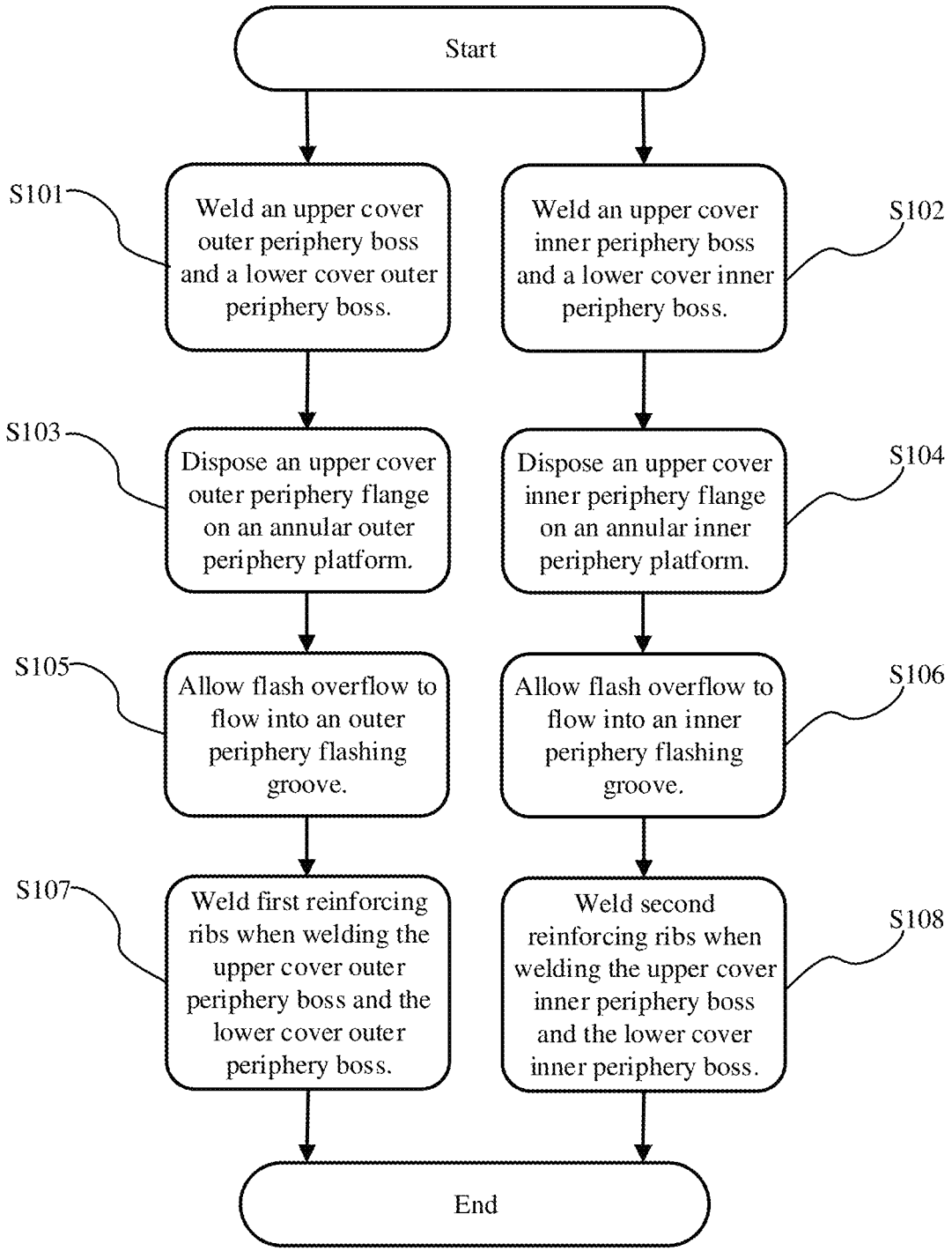
FIG. 9 is a flow chart of a method for assembling the toilet seat according to an embodiment of the present disclosure.

FIG. 9 is a flow chart of a method for assembling the toilet seat according to an embodiment of the present disclosure. The toilet seat assembled by this method may be a toilet seat as discussed above. The toilet seat assembled by this method is configured to perform an operation, function, or the like as described in the present disclosure.

At act S101, a user may connect the upper cover outer periphery boss 24 of the seat upper cover 2 to the lower cover outer periphery boss 14 of the seat lower cover 1.

The lower cover outer periphery boss 14 is disposed at the inner side of the outside edge of the lower cover baseplate 11 of the seat lower cover 1. The annular outer periphery platform 12 is formed between the lower cover outer periphery boss 14 and the outside edge of the lower cover baseplate 11.

In this embodiment, the upper cover outer periphery boss 24 is connected to the lower cover outer periphery boss 14 via welding.

At act S102, the user may connect the upper cover inner periphery boss 25 of the seat upper cover 2 to the lower cover inner periphery boss 15 of the seat lower cover 1.

The lower cover inner periphery boss 15 is disposed at the outer side of the lower cover through hole 110 of the lower cover baseplate 11. The annular inner periphery platform 13 is formed between the lower cover inner periphery boss 15 and the outside edge of the lower cover baseplate 11.

In this embodiment, the upper cover inner periphery boss 25 is connected to the lower cover inner periphery boss 15 via welding.

At act S103, the user may dispose at least a portion of the upper cover outer periphery flange 22 of the seat upper cover 2 on the annular outer periphery platform 12.

At act S104, the user may dispose at least a portion of the upper cover inner periphery flange 23 of the seat upper cover 2 on the annular inner periphery platform 13.

At act S105, the user may allow the flash overflow produced when welding the upper cover outer periphery boss 24 and the lower cover outer periphery boss 14 to flow into the outer periphery flashing groove 26 formed between the upper cover outer periphery boss 24 and the upper cover outer periphery flange 22.

At act S106, the user may allow the flash overflow produced when welding the upper cover inner periphery boss 25 and the lower cover inner periphery boss 15 to flow into the inner periphery flashing groove 27 formed between the upper cover inner periphery boss 25 and the upper cover inner periphery flange 23.

At act S107, the user may weld the plurality of first reinforcing ribs 28 when welding the upper cover outer periphery boss 24 and the lower cover outer periphery boss 14.

At act S108, the user may weld the plurality of second reinforcing ribs 29 when welding the upper cover inner periphery boss 25 and the lower cover inner periphery boss 15.

The above acts of the method may be performed at the same time or in different sequences. In this embodiment, act S101 and act S102 may be performed at the same time (e.g., at a time T1), act S103 and act S104 may be performed at the same time (e.g., at a time T2, which is later than T1), act S105 and act S106 may be performed at the same time (e.g., at a time T3, which is later than T2), and act S107 and act S108 may be performed at the same time (e.g., at a time T4, which is later than T3). However, in another embodiment, act S101-act S108 may be performed in different sequences. For example, act S101, act S103, act S105, and act S107 may be performed before act S102, act S104, act S106, and act S108.

According to the needs, the above technical solutions may be combined to achieve the best technical effect.

The above only describes the principles and the embodiments of the present disclosure. It should be pointed out that for those having ordinary skill in the art, several other modifications can be made on the basis of the principle of the present disclosure, which should also be regarded as the scope of protection of the present disclosure.

I claim:

1. A toilet seat, comprising:

a seat lower cover comprising:

a lower cover baseplate including a lower cover through hole;

a lower cover outer periphery boss surrounding an inner side of an outside edge of the lower cover baseplate; and a lower cover inner periphery boss surrounding an outer side of the lower cover through hole;

a seat upper cover mounted on the seat lower cover, the seat upper cover comprising:

an upper cover baseplate including an upper cover through hole;

an upper cover outer periphery flange extending downwardly from an outside edge of the upper cover baseplate;

an upper cover inner periphery flange extending downwardly from an edge of the upper cover through hole;

an upper cover outer periphery boss surrounding an inner side of the upper cover outer periphery flange; and an upper cover inner periphery boss surrounding an outer side of the upper cover inner periphery flange, wherein the upper cover inner periphery boss is configured to be connected to the lower cover inner periphery boss, wherein the upper cover outer periphery boss is configured to be connected to the lower cover outer periphery boss, and wherein the upper cover outer periphery flange and the upper cover inner periphery flange are configured to be contacted with the lower cover baseplate respectively, wherein an inner periphery flashing groove is formed between the upper cover inner periphery boss and the upper cover inner periphery flange, wherein the upper cover inner periphery boss extends below a top portion of the inner periphery flashing groove and the upper cover inner periphery flange extends below the top portion of the inner periphery flashing groove, wherein the upper cover inner periphery boss is configured to be welded with the lower cover inner periphery boss, and wherein the inner periphery flashing groove is configured to receive flash overflow produced when welding the upper cover inner periphery boss and the lower cover inner periphery boss.

2. The toilet seat according to claim 1, wherein a plurality of outer periphery boss recesses are arranged on the upper cover outer periphery boss at intervals.

3. The toilet seat according to claim 2, wherein a plurality of inner periphery boss recesses are arranged on the upper cover inner periphery boss at intervals.

4. The toilet seat according to claim 1, wherein a plurality of first reinforcing ribs are connected between the upper cover outer periphery boss and the upper cover outer periphery flange.

5. The toilet seat according to claim 1, wherein a plurality of second reinforcing ribs are connected between the upper cover inner periphery boss and the upper cover inner periphery flange.

6. The toilet seat according to claim 1, wherein a width of the lower cover inner periphery boss is greater than a width of the upper cover inner periphery boss, and wherein a width of the lower cover outer periphery boss is greater than a width of the upper cover outer periphery boss.

7. The toilet seat according to claim 1, wherein the upper cover outer periphery flange, the upper cover inner periphery flange, the upper cover outer periphery boss, and the upper cover inner periphery boss are integrally formed with the upper cover baseplate respectively.

8. The toilet seat according to claim 1, wherein the lower cover outer periphery boss and the lower cover inner periphery boss are integrally formed with the lower cover baseplate respectively.

9. A method for assembling a toilet seat comprising a seat lower cover and a seat upper cover, the method comprising:

connecting an upper cover outer periphery boss of the seat upper cover to a lower cover outer periphery boss of the seat lower cover, wherein the lower cover outer periphery boss is disposed at an inner side of an outside edge of a lower cover baseplate of the seat lower cover, and wherein an annular outer periphery platform is formed between the lower cover outer periphery boss and the outside edge of the lower cover baseplate, and connecting an upper cover inner periphery boss of the seat upper cover to a lower cover inner periphery boss of the seat lower cover, wherein the lower cover inner periphery boss is disposed at an outer side of a lower cover through hole of the lower cover baseplate, and wherein an annular inner periphery platform is formed between the lower cover inner periphery boss and an outside edge of the lower cover baseplate, wherein the upper cover inner periphery boss is connected to the lower cover inner periphery boss via welding, allowing flash overflow produced when welding the upper cover inner periphery boss and the lower cover inner periphery boss to flow into an inner periphery flashing groove formed between the upper cover inner periphery boss and the upper cover inner periphery flange, wherein the upper cover inner periphery boss extends below a top portion of the inner periphery flashing groove and the upper cover inner periphery flange extends below the top portion of the inner periphery flashing groove.

10. The method according to claim 9, further comprising:

disposing at least a portion of an upper cover outer periphery flange of the seat upper cover on the annular outer periphery platform; and disposing at least a portion of an upper cover inner periphery flange of the seat upper cover on the annular inner periphery platform.

11. The method according to claim 10, wherein the upper cover outer periphery boss is connected to the lower cover outer periphery boss via welding, wherein the method further comprises:

allowing flash overflow produced when welding the upper cover outer periphery boss and the lower cover outer periphery boss to flow into an outer periphery flashing groove formed between the upper cover outer periphery boss and the upper cover outer periphery flange.

12. The method according to claim 11, wherein a plurality of first reinforcing ribs is formed between the upper cover outer periphery boss and the upper cover outer periphery flange, and wherein the method further comprises:

welding the plurality of first reinforcing ribs when welding the upper cover outer periphery boss and the lower cover outer periphery boss.

13. The method according to claim 12, wherein the plurality of first reinforcing ribs are aligned with the upper cover outer periphery boss.

14. The method according to claim 9, wherein a plurality of second reinforcing ribs between the upper cover inner periphery boss and the upper cover inner periphery flange, and wherein the method further comprises:

welding the plurality of second reinforcing ribs when welding the upper cover inner periphery boss and the lower cover inner periphery boss.

15. The method according to claim 14, wherein the plurality of second reinforcing ribs are aligned with the upper cover inner periphery boss.

16. The method according to claim 10, wherein the upper cover outer periphery flange, the upper cover inner periphery flange, the upper cover outer periphery boss, and the upper cover inner periphery boss are integrally formed with the upper cover baseplate respectively, and wherein the lower cover outer periphery boss and the lower cover inner periphery boss are integrally formed with the lower cover baseplate respectively.

17. The method according to claim 9, wherein a width of the lower cover inner periphery boss is greater than a width of the upper cover inner periphery boss, and a width of the lower cover outer periphery boss is greater than a width of the upper cover outer periphery boss.

18. A toilet seat, comprising:

a seat lower cover comprising:

a lower cover baseplate including a lower cover through hole;

a lower cover outer periphery boss surrounding an inner side of an outside edge of the lower cover baseplate; and a lower cover inner periphery boss surrounding an outer side of the lower cover through hole;

a seat upper cover mounted on the seat lower cover, the seat upper cover comprising:

an upper cover baseplate including an upper cover through hole;

an upper cover outer periphery flange extending downwardly from an outside edge of the upper cover baseplate;

an upper cover inner periphery flange extending downwardly from an edge of the upper cover through hole;

an upper cover outer periphery boss surrounding an inner side of the upper cover outer periphery flange; and an upper cover inner periphery boss surrounding an outer side of the upper cover inner periphery flange, wherein the upper cover inner periphery boss is configured to be connected to the lower cover inner periphery boss, wherein the upper cover outer periphery boss is configured to be connected to the lower cover outer periphery boss, and wherein the upper cover outer periphery flange and the upper cover inner periphery flange are configured to be contacted with the lower cover baseplate respectively, wherein an outer periphery flashing groove is formed between the upper cover outer periphery boss and the upper cover outer periphery flange, wherein the upper cover outer periphery boss extends below a top portion of the outer periphery flashing groove and the upper cover outer periphery flange extends below the top portion of the outer periphery flashing groove, wherein the upper cover outer periphery boss is configured to be welded with the lower cover outer periphery boss, and wherein the outer periphery flashing groove is configured to receive flash overflow produced when welding the upper cover outer periphery boss and the lower cover outer periphery boss.

* * * * *